US005138390A

United States Patent [19]

Miyabayashi et al.

[11] Patent Number: 5,138,390

[45] Date of Patent: Aug. 11, 1992

[54] CLEANING SHEET FOR FIXATING ROTATIONAL MEMBER AND IMAGE FORMING APPARATUS HAVING FIXATING ROTATIONAL MEMBER

[75] Inventors: Toshiyuki Miyabayashi, Ohmachi; Masaaki Takahashi, Asaka; Kazuo Kishino, Kawasaki; Yoji Tomoyuki; Yasumasa Ohtsuka, both of Yokohama, all of Japan

[73] Assignee: Canon Kabushiki Kaisha, Tokyo, Japan

[21] Appl. No.: 815,853

[22] Filed: Dec. 31, 1991

Related U.S. Application Data

[63] Continuation of Ser. No. 450,080, Dec. 13, 1989, abandoned.

[30] Foreign Application Priority Data

| | | | |
|---|---|---|---|
| Dec. 14, 1988 | [JP] | Japan | 63-316752 |
| Dec. 14, 1988 | [JP] | Japan | 63-316753 |
| Jan. 13, 1989 | [JP] | Japan | 1-006501 |
| Jan. 25, 1989 | [JP] | Japan | 1-016551 |

[51] Int. Cl.[5] ..... G03G 15/20

[52] U.S. Cl. ..... 355/283; 355/211; 15/256.51; 346/160.1

[58] Field of Search ..... 355/210, 211, 283, 285; 118/104; 15/256.51; 346/160.1

[56] References Cited

U.S. PATENT DOCUMENTS

| | | | |
|---|---|---|---|
| 4,046,468 | 9/1977 | Stryjewski | 355/285 |
| 4,719,489 | 1/1988 | Ohkubo et al. | 355/290 |
| 4,742,483 | 5/1988 | Morrell | 364/900 |
| 4,873,548 | 10/1989 | Kobayashi et al. | 355/211 X |

FOREIGN PATENT DOCUMENTS

| | | | |
|---|---|---|---|
| 0203640 | 12/1986 | European Pat. Off. . | |
| 0281372 | 9/1988 | European Pat. Off. . | |
| 2064559 | 7/1971 | Fed. Rep. of Germany . | |
| 56-9773 | 1/1981 | Japan | 355/283 |
| 60-196787 | 10/1985 | Japan . | |
| 2071575 | 9/1981 | United Kingdom . | |

OTHER PUBLICATIONS

*Research Disclosure,* No. 127, Nov. 1974, Stryjewski, W. A., "Method and apparatus for cleaning fusing members of electrophotographic copiers", pp. 30–32.

*IBM Technical Disclosure Bulletin,* vol. 25, No. 7B, Dec. 1982, Chang et al., "Heated Fuser Roll Cleaning Process", pp. 3986–3987.

*IBM Technical Disclosure Bulletin,* vol. 18, No. 8, Jan. 1976, Brandon et al., "Copier cleaning", p. 2438.

*Primary Examiner*—Joan H. Pendegrass

*Attorney, Agent, or Firm*—Fitzpatrick, Cella, Harper & Scinto

[57] ABSTRACT

A cleaning sheet for a fixating rotational member has a tacky layer provided on at least one surface of the cleaning sheet and having tackiness to toner at least when the cleaning sheet is conveyed to the fixating rotational member.

36 Claims, 9 Drawing Sheets

CLEANING SHEET FOR FIXATING ROTATIONAL MEMBER AND IMAGE FORMING APPARATUS HAVING FIXATING ROTATIONAL MEMBER

This application is a continuation of application Ser. No. 450,080 filed Dec. 13, 1989, now abandoned.

BACKGROUND OF THE INVENTION

1. Field of the Invention

The present invention relates to a cleaning sheet for fixating rotational member, and an image forming apparatus having a fixating rotational member.

2. Related Background Art

In image forming apparatus such as copying apparatuses, laser beam printers and magnestylus printers, it is widely practised to form an unfixated toner image on a support material, and thereafter effect fixation by a fixating rotational member, particularly, a pair of rotational members.

In order to prevent toner and paper powder adhering to the fixating rotational member(s) from spreading to the support material to deteriorate the quality of image, felt, a web or the like is brought into contact with the fixating rotational member(s) to thereby clean the latter.

An example of such a fixating device is shown in FIG. 8 of the accompanying drawings.

The reference numeral 1 designates a fixating roller which comprises a mandrel 12 of aluminum, iron or like material and a resin layer 13 of good parting property such as PFA or PTFE provided on the mandrel 12 and the interior of which may be heated by a heater H. The surface temperature of the fixating roller 1 is detected by a temperature detecting element 19, and is controlled to a predetermined temperature by turning on or off the heater H by a temperature control circuit (not shown).

On the other hand, the reference numeral 2 denotes a pressing roller which comprises a metallic mandrel 21 of iron, stainless steel or the like and an elastic material layer 22 of silicone rubber, fluorine rubber or the like having a heat resisting property and a good parting property and formed on the metallic mandrel 21.

A recording material P carrying a toner image T thereon is directed to between the fixating roller 1 and the pressing roller 2 by an entrance guide 23, and is heated and pressed, whereby the image is fixated. Thereafter, the recording material P is peeled from the fixating roller 1 by a separating pawl 10.

The reference numeral 18 designates cleaning felt which comprises a felt material such as Normex (the registered trademark of Du Pont, Inc.) impregnated with a parting agent such as silicon oil and serves to remove toner and paper powder adhering to the surface layer of the fixating roller 1.

In recent years, however, as the tendency of the apparatus toward compactness and lower cost has progressed, the desire to eliminate the cleaning device has become stronger.

For this reason, efforts have been made to improve the parting (mold releasing) property of the surface of the fixating rotational member and overcome the electrostatic problem, but it has been impossible to keep a good quality of image for a long period of time.

Particularly, as, regards the pair of rotational members, the stains on the rotational member which does not contact with the unfixated toner image have been serious and the problem of the back of the support material becoming stained has occurred.

SUMMARY OF THE INVENTION

It is an object of the present invention to overcome the above defects of the relevant prior art of the cleaning sheet and/or the image forming apparatus having the fixating rotational member.

It is another object of the present invention to provide a cleaning sheet for a fixating rotational member having a tacky layer provided on at least one surface of the cleaning sheet and having tackiness to toner at least when the cleaning sheet is conveyed to the fixating rotational member.

It is still another object of the present invention to provide a method of cleaning a fixating rotational member having steps of conveying a cleaning sheet having on the surface of it a tacky layer having tackiness at least when the cleaning sheet is conveyed to the fixating rotational member toward the fixating rotational member substantially at each predetermined member of times, and conveying the conveyed cleaning sheet to said fixating rotational member.

It is still another object of the present invention to provide a method of cleaning the fixating rotational member of an image forming apparatus provided with means for forming an unfixated toner image on a support material and a fixating rotational member for conveying the support material to thereby fixate the unfixated toner image, having steps of conveying a cleaning sheet having on the surface thereof a tacky layer having tackiness at least when said cleaning sheet is conveyed to said fixating rotational member, toward said fixating rotational member substantially in conformity with the amount of toner used; and conveying the conveyed cleaning sheet by said fixating rotational member.

It is still another object of the present invention to provide an image forming apparatus having means for forming an unfixated-toner image on a recording material in conformity with an image signal; a pair of rotational members for nipping and conveying the recording material therebetween and fixating the unfixated toner image on the recording material; and memory means for memorizing an image signal corresponding to a solid image; wherein image formation being possible on the basis of the output image signal from said memory means.

It is still another object of the present invention to provide an expendable used in an image forming apparatus, having a packing container for packing said expendable; and a cleaning sheet for cleaning a fixating rotational member in said image forming apparatus; wherein said cleaning sheet being contained in said packing container with said expendable.

DESCRIPTION OF THE PREFERRED EMBODIMENTS

Some embodiments of the present invention will hereinafter be described.

Figure 1:
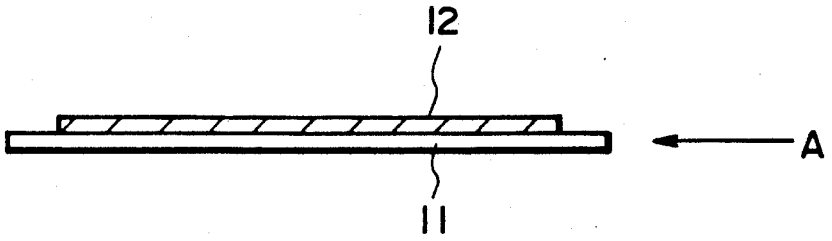
FIG. 1 is a side view of a cleaning sheet according to an embodiment of the present invention.
Figure 2:
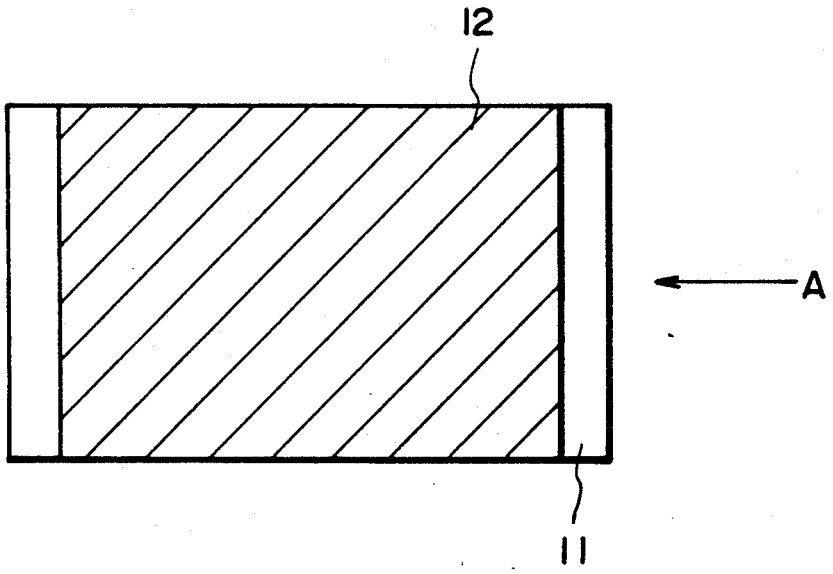
FIG. 2 is a top plan view of the FIG. 1 embodiment.

FIG. 1 is a side view of a cleaning sheet according to an embodiment of the present invention and FIG. 2 is a plan view of the FIG. 1 embodiment.

The reference numeral 11 designates a sheet substrate formed of paper or resin. The reference numeral 12 denotes a tacky layer provided on the sheet substrate 11, and the arrow A indicates the direction of conveyance during the use of the cleaning sheet. The tacky layer 12 is formed leaving uncovered the end portions of the sheet as viewed in the direction of conveyance. Therefore, the sheet can be reliably separated without twining around a fixating rotational member.

Also, this cleaning sheet is provided at the maximum paper supply width size of the apparatus used and over the full width in a direction intersecting the direction of conveyance. (That is, it is provided at A4 width if the maximum paper supply size is A4).

Therefore, there is no problem in the conveyance property, and it is possible to remove all stains which pose a problem.

Further, the length of the tacky layer in the direction of conveyance is greater than the circumferential length of the rotational member to be cleaned. Therefore, the rotational member can be reliably cleaned over the full circumference thereof by the supply of a single cleaning sheet.

A cleaning sheet according to another embodiment of the present invention will now be described in detail.

An aqueous tackifier (acrylic emulsion) having tackiness even at room temperature — Three Bond #1549 produced by Three Bond Co., Ltd. — was applied to both sides of a polyethylene terephthalate sheet having a size of 220 mm ×300 mm and a thickness of 100 μm over an area of 220 mm ×250 mm thereof so that the thickness of the tackifier was 5 μm, and was dried at 40° C. for one hour to thereby make a cleaning sheet. When in an electrophotographic apparatus, said cleaning sheet was passed between fixating rollers (a fixating roller and a pressing roller) in a fixating device having the surfaces thereof stained by toner and paper powder, the stains on the surfaces of the two rollers were all removed and the rollers recovered their state before they were used.

Ethylene-vinyl acetate copolymer was applied to one side of a paper sheet of 80 g/m$^2$ A4 size so that the thickness thereof was 5 μm, whereby a cleaning sheet was obtained. The ethylene-vinyl acetate copolymer used, which is thermoplastic resin, had a melting viscosity of 1×104 poise at 150° C., and it was dissolved into ethylene acetate and was applied to papers, whereafter the ethylene acetate was volatilized and removed.

Further, a parting or mold releasing sheet of heat resisting property was placed on it and the ethylene-vinyl acetate copolymer was heated and melted at 150° C to thereby make an ethylene-vinyl acetate copolymer coat cleaning sheet.

In the heat fixating rollers of the fixating device of an electrophotographic apparatus, the fixating roller comprises a cylindrical aluminum alloy mandrel having an outer diameter of 20 mm and a thickness of 2 mm and having the surface thereof coated with PFA resin, and the pressing roller comprises a stainless steel mandrel having an outer diameter of 10 mm and an elastic layer of silicone rubber provided on the mandrel so that the outer diameter thereof is 20 mm. The fixating roller and the pressing roller are urged against each other with a predetermined pressure force of 60 kg. These are not provided with a cleaning device. The fixating roller is maintained at about 150° C.

When a predetermined number of sheets are used, paper powder and toner adhere to the surface of the pressing roller over a wide area thereof and the conveyance property and fixativeness are extremely aggravated. When in this state, said cleaning sheet was passed between the rollers with the coated surface of the cleaning sheet facing the pressing roller, the paper powder and toner adhering to the surface of the pressing roller all shifted to the surface of the cleaning sheet and the stains on the surface of the pressing roller were all removed and the surface of the pressing roller recovered its initial state.

The cleaning sheet according to this embodiment has no tackiness at room temperature, and it obtains tackiness by being heated by the fixating roller.

Therefore, this cleaning sheet can be used in an apparatus having a member contacting with the tacky layer in the course of conveyance to the fixating roller, and is particularly effective for an image forming apparatus of the transfer type in which an unfixated toner image on a photosensitive member is transferred to a support member by a transfer device.

Also, in this case, the material of the tacky layer may most preferably be the same material as the toner used in the image forming apparatus, from the viewpoint of the cleaning property of offset toner.

Thus, offset toner or the like is removed by the cleaning sheet and therefore, without providing any special cleaning mechanism for the fixating rotational member, good fixated images can be obtained for a long period of time.

Figure 3:
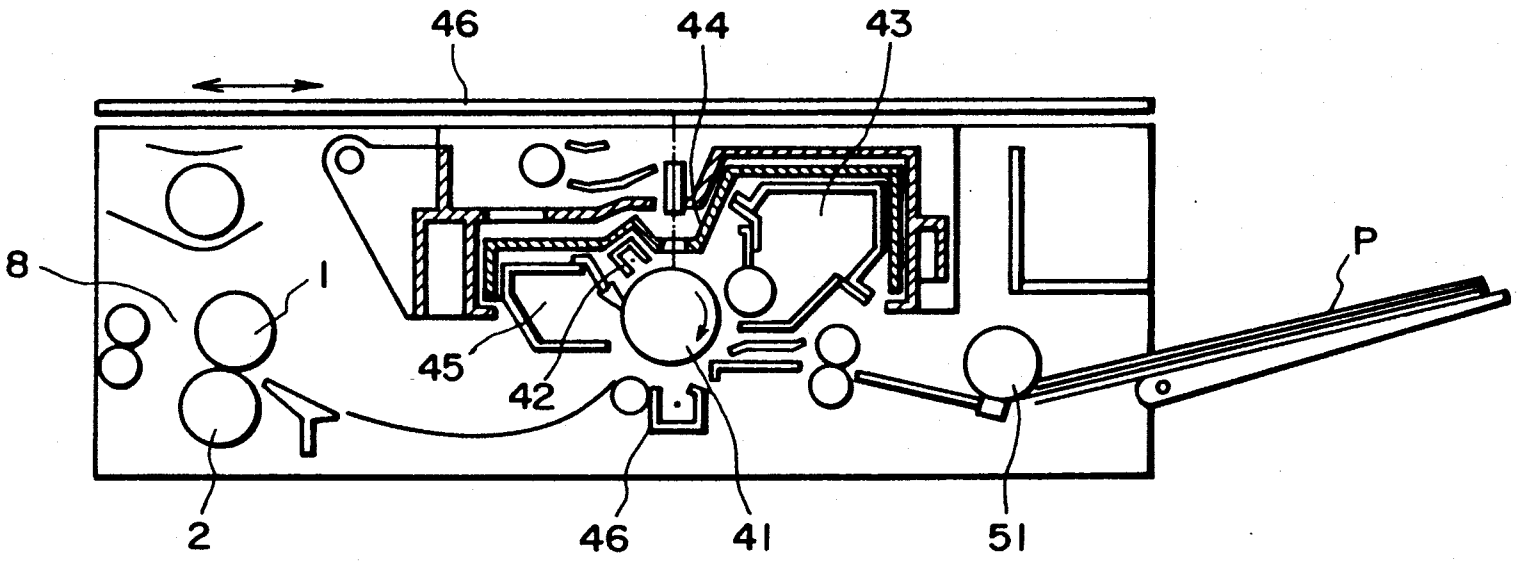
FIG. 3 is a cross-sectional view of a copying apparatus provided with a fixating rotational member which is a member to be cleaned in the embodiment of the present invention.

FIG. 3 shows an image forming apparatus having a fixating rotational member cleaned by a cleaning sheet.

The reference numeral 44 designated a process cartridge having integrally therein a photosensitive member 41 movable in the direction of arrow, a charger 42 for uniformly charging the photosensitive member, a developing device containing therein unfixated toner for developing an electrostatic latent image formed on the photosensitive member, and a cleaner 45 for removing any residual toner on the photosensitive member.

The image of an original placed on an original supporting table 46 is formed on the photosensitive member 41, whereby an electrostatic latent image is formed thereon, and the unfixated toner image developed by the developing device 43 is transferred by a transfer charger 46 onto a support material P fed in timed relationship with the photosensitive member.

The support material supporting the unfixated toner image thereon is fixated by a fixating device 8, whereafter it is discharged out of the apparatus.

The fixating device 8 will now be described with reference to FIG. 4.

A heating-fixating roller 1 comprises a cylindrical mandrel of aluminum alloy (5056) having an outer diameter of 20 mm and a thickness of 2 mm and having the surface thereof coated with PFA resin. A pressing roller 2 comprises a mandrel of stainless steel having an outer diameter of 10 mm, and an elastic layer of silicone rubber provided on the mandrel, and has a surface hardness of 30° (JISA) and an outer diameter of 20 mm, and this pressing roller is rotatably urged against the heating-fixating roller with a total pressure force of 6 kg by the use of a spring 6.

A halogen heater of 500 W is used as the heating means H of the fixating device, and an NTC thermistor as heating-fixating roller surface temperature detecting means is brought into contact with the heating-fixating roller, and the surface temperature is controlled by conventional control means so as to be maintained at about 150° C.

This fixating device is not provided with a member for cleaning the rollers 1 and 2 for fixation, such as felt or a web.

An embodiment of the cleaning sheet used in the present invention will now be described.

Figure 5:
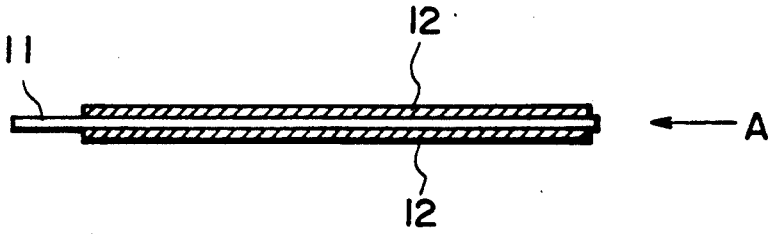
FIGS. 5 and 6 are side views of cleaning sheets used in present invention.

An original of A4 size whose substantially whole surface was black was copied on a paper sheet 11 of 80 g/m$^2$ A4 size by the apparatus of the FIG. 3 embodiment, and further, toner was also fixated on the substantially whole back surface of said paper sheet, thereby obtaining a cleaning sheet having tacky layers 12 on both sides thereof as shown in FIG. 5. The arrow A in FIG. 5 indicates the direction of conveyance of the cleaning sheet. The material of the cleaning sheet is not limited to paper if it permits fixation of toner.

When in the copying apparatus of FIG. 3, a test pattern original was placed on the original supporting table and a copying test was carried out at a frequency of four paper sheets of A4 size (52 g/m$^2$) per minute, the adherence of paper powder to the surface of the pressing roller 2 was found for about 5,000 paper sheets, and along therewith, offset increased. Further, when at a point of time whereat the adherence of toner to the pressing roller occurred when about 10,000 paper sheets were supplied, the aforedescribed cleaning sheet was supplied from a paper supply tray, the stains on the pressing roller were all removed and the offset property recovered its initial level. This owes to the tackiness presenting itself because the fixated toner on the cleaning sheet was remelted at the fixating nip portion.

When thereafter, a cleaning sheet was supplied for each supply of 5,000 paper sheets to thereby continue the paper supply test, no trouble concerned with the conveyance property and fixativeness occurred at all until the supply of 200,000 paper sheets was terminated.

On the other hand, when no cleaning sheet was supplied, the twining of the test paper attributable to the toner stains of the pressing roller occurred and paper supply became impossible at a point of time whereat about 15,000 paper sheets were supplied after the start of the paper supply test.

Figure 4:
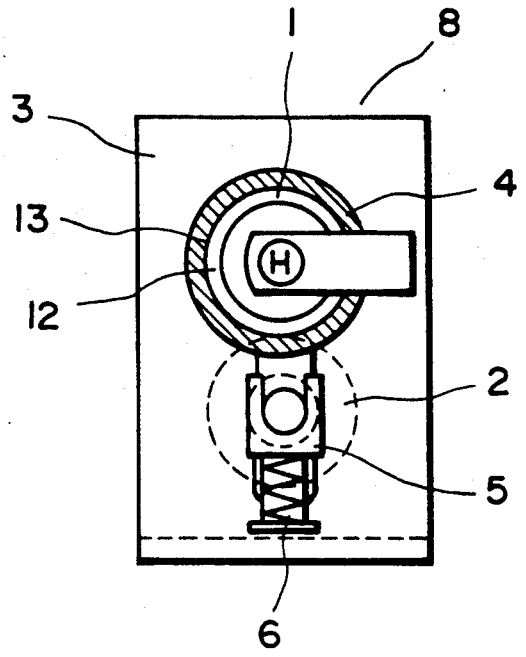
FIG. 4 is a cross-sectional view of a fixating device used in the apparatus shown in FIG. 3.

Also, when in the fixating device shown in FIG. 4, felt impregnated with silicone oil was urged as a cleaning member against the heating-fixating roller and a similar paper supply test was carried out, the anti-stain life of the pressing roller was prolonged, but the cleaning power of the felt was reduced at a point of time whereat about 50,000 paper sheets were supplied, and the twining of the test paper attributable to the toner stains of the pressing roller occurred again and paper supply became impossible.

In the present embodiment, the tacky layers 12 have no tackiness at room temperature, and tackiness presents itself when the cleaning sheet is nipped and conveyed by the rollers 1 and 2 for fixation.

Therefore, no problem arises in the conveyance to the fixating device and high tackiness is obtained during cleaning. Further, the cleaning sheet is not provided with the tacky layers in the end portions thereof as viewed in the direction of conveyance. Therefore, it can be reliably separated from the rollers.

Also, in the embodiment of FIG. 3, as the frequency of copying is increased, not only do the rollers for fixation become more heartily stained, but paper powder also adheres to the paper supply roller 51, etc. and slippage tends to occur.

Description will now be made of a cleaning sheet capable of cleaning not only the rollers for fixation, but also the paper feed roller, etc.

Figure 6:
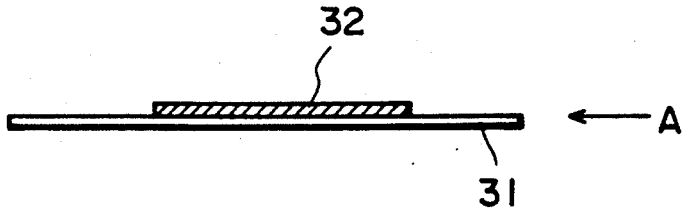

A cleaning sheet was made in the following manner. Aqueous acryl emulsion (an aqueous tacky agent) was applied onto a sheet of polyethylene phthalate having a size of 220 mm ×220 mm and a thickness of 100 μm over an area of 100 mm ×220 mm so that the thickness of the emulsion was 5 μm, and the emulsion was dried at about 40° C. for one hour, to thereby make a cleaning sheet as shown in FIG. 6.

Figure 7:
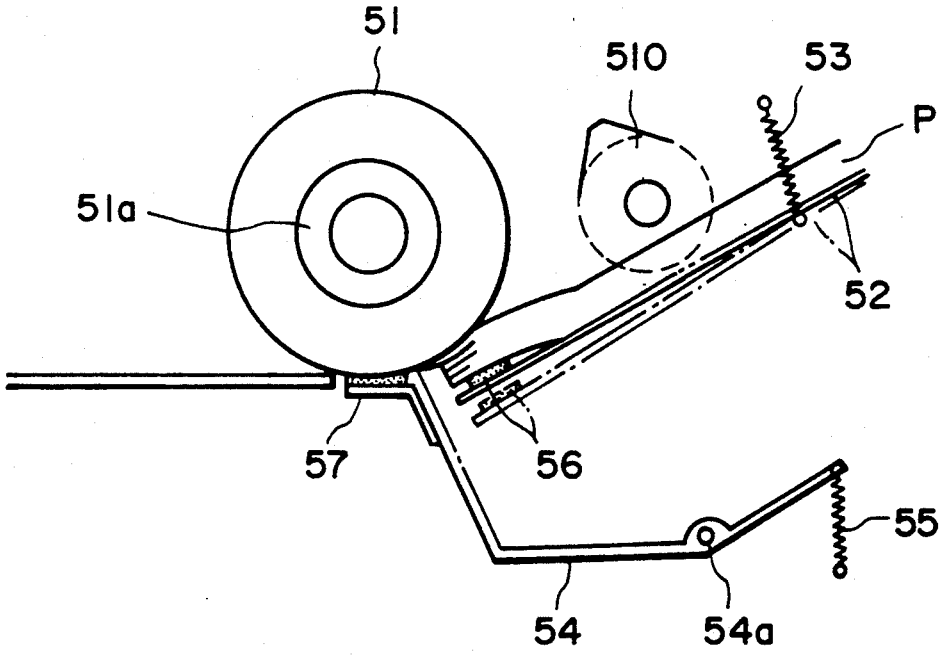
FIG. 7 is an enlarged view of a paper feed device used in the apparatus shown in FIG. 3.
Figure 8:
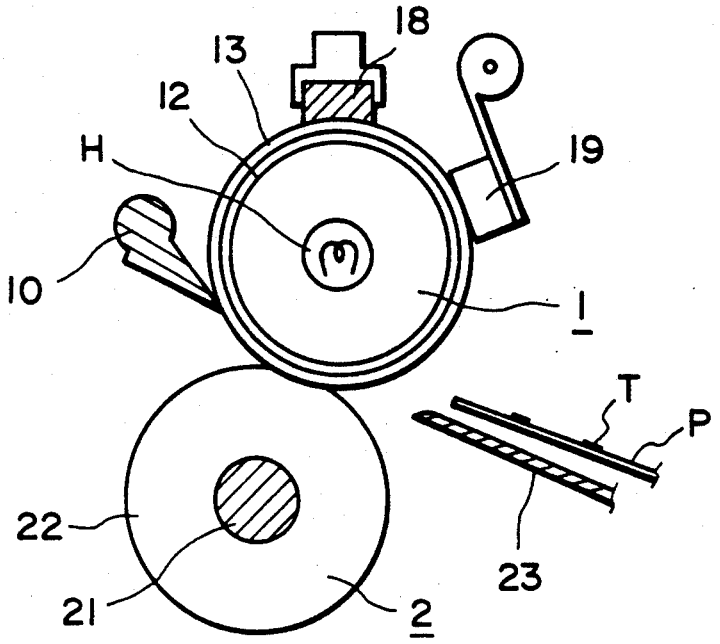
FIG. 8 is a longitudinal cross-sectional view of a fixating device according to the prior art.

The paper feed device of the copying apparatus of FIG. 3 will now be described with reference to the drawings. FIG. 7 schematically shows the construction of the paper feed device. The reference numeral 51 designates a paper feed roller of urethane rubber rotatably mounted on a shaft 51*a* in the machine and having an outer diameter of 38 mm, a length of 40 mm, an elastic layer thickness of 10 mm and a roller hardness of 35°, and the reference numeral 52 denotes a conveyed material supporting member having one end portion thereof, not shown, pivotably mounted on the apparatus body, and vertically movable in response to the rotation of an eccentric cam 510.

The reference numeral 53 designates a spring for biasing the free end of the conveyed material supporting member 52 toward the feed roller, the reference numeral 54 denotes a conveyed material separating member pivotably mounted on a shaft 54*a* in the apparatus body, the reference numeral 55 designates a spring for biasing the free end of the conveyed material separating member 54 toward the feed roller, and the reference numerals 56 and 57 denote conveyed material separating sheets such as resin pads provided on the free end side upper surfaces of the conveyed material supporting member 52 and the conveyed material separating member 54.

In this system, the conveyed material separating member 54 is normally urged axially of the paper feed roller 51 relative to the paper feed roller with predetermined pressure. The uppermost sheet is adapted to be separated from the other conveyed materials and fed by the cooperation between the paper feed roller 51 and the conveyed material separating sheet 56 urged against the paper feed roller 51 by the spring 53.

When in the above-described paper feed device, the force with which the conveyed material separating sheet 57 pushed the roller 51 by means of the spring 55 was 250 g and the rotational speed of the roller 51 was 80 mm/sec. and A4. size paper (120 g/m$^2$) was fed, the sliding phenomenon due to the reduction in $\mu$(the coefficient of friction) attributable to paper powder adhering to the surface of the paper feed roller occurred and paper feed became impossible after about 50,000 paper sheets were supplied.

Here, when a cleaning sheet of the present invention was supplied, the paper powder on the surface of the roller was substantially removed and the paper feeding performance was recovered. When thereafter, the paper feeding test was continued by supplying a cleaning sheet for each supply of 5,000 paper sheets, no trouble concerned with the paper feeding performance occurred at all until the supply of 200,000 paper sheets was terminated.

Thus, according to this embodiment, the cleaning sheet has tackiness even at room temperature and therefore can clean not only the rollers for fixation, but also the paper feed roller having no heat source therein.

However, if the tackiness is heightened, there will arise a problem in the conveyance property and jam will become ready to occur and therefore, to obtain a high cleaning capability, it is preferable that as in the aforedescribed embodiment, the cleaning sheet come into contact with the rollers for fixation to thereby present tackiness.

In the above-described embodiment, a cleaning sheet was supplied for each supply of 5,000 paper sheets, but depending on the apparatus, a cleaning sheet may be supplied for each supply of 1,000 paper sheets or 10,000 paper sheets. Also, the predetermined number of the paper sheets need not always be exactly 5,000 or 10,000, but may be approximate thereto.

In the image forming apparatus as shown in FIG. 3 wherein an unfixated toner image is formed on a support member, the amount of toner used and the frequency of fixation substantially agree with each other.

Therefore, the cleaning sheet may also be supplied in conformity with the amount of toner used. That is, when the toner becomes exhausted and the process cartridge 44 having an image bearing member and at least one process means for acting on this image bearing member is to be replaced with new one, a cleaning sheet may be supplied.

By thus supplying a cleaning sheet in conformity with the amount of toner used, cleaning is effected substantially for each predetermined number of paper sheets and also, it becomes unnecessary to count the frequency of fixation each time, and this is preferable.

A further preferred embodiment of the present invention will now be described.

Figure 9:
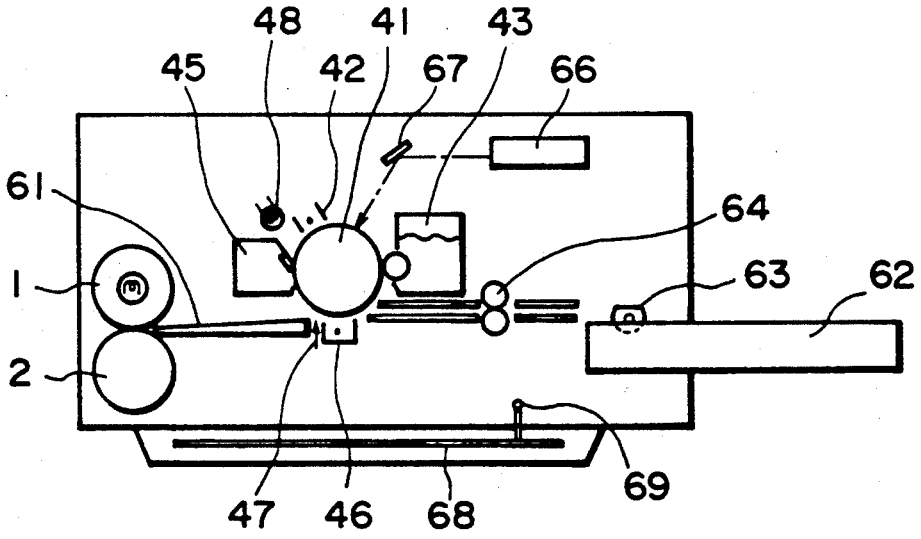
FIG. 9 is a longitudinal cross-sectional view of a laser beam printer according to an embodiment of the present invention.

FIG. 9 is a cross-sectional view of a laser beam printer which is an electrophotographic apparatus of the digital recording type according to an embodiment of the present invention.

Recording materials are piled in a cassette 62, and are fed one by one by a paper feed roller 63 with a print starting command input from a computer or the like, not shown. Register rollers 64 feed out the recording material in timed relationship with a photosensitive drum 41 so that the leading end edge of the image on the photosensitive drum 41 and the leading end edge of the recording material may be coincident with each other.

On the photosensitive drum 41 uniformly charged by a charger 42, an electrostatic latent image conforming to an image signal is formed by the photosensitive drum being scanned by a laser beam emitted from a laser scanner 66 containing therein a semiconductor laser emitting a laser beam modulated in conformity with the image signal, a rotatable polygonal mirror for deflecting the laser beam emitted from the semiconductor laser etc. The reference numeral 67 designate a reflecting mirror for reflecting the laser beam.

The electrostatic latent image thus formed on the photosensitive drum 41 is visualized into an unfixated toner image by a developing device 43 and transferred onto the recording material by a transfer charger 46. Any excess charges accumulated on the recording material are removed by a charge removing needle 47, and the unfixated toner image on the recording material is fixated by heat and pressure being applied thereto when the recording material is nipped and conveyed by a fixating roller 1 and a pressing roller 2.

On the other hand, any toner and paper powder remaining on the photosensitive drum 41 are removed by a cleaner 45, and any charges remaining on the photosensitive drum 41 are also removed by a pre-exposure lamp 48. The photosensitive drum 41 is then utilized again for the primary charging and subsequent steps.

These image forming processes, the control of the conveyance of the recording material, etc. are controlled by a CPU provided on an electrical base plate 68.

An ROM for storing the image signal of a test pattern therein is also provided on the electrical base plate 68, and by depressing a test print switch 69, the laser beam is modulated by the image signal output from the ROM, whereby an image of predetermined pattern is formed on the recording material, which is then discharged. By reversing and refeeding the recording material on which this pattern has been formed, the cleaning of the pressing roller is accomplished.

The image of the test pattern will now be described with reference to FIG. 10.

This pattern is endowed with blanks of $l_1$ and $l_3$ at the front end and rear end thereof, respectively. The blanks of $l_1$ and $l_3$ are for making it easy to separate the test pattern from the pressing roller during the resupply of paper, and according to the experiment, they may be 4 mm or more, and more preferably be 10 mm or more. The reason why such blanks are provided at the opposite ends is that the user may supply paper in any direction. Also, the solid painted portion has a length $l_2$ with respect to the direction of feeding. This $l_2$ may be equal to or greater than the circumferential length of the pressing roller, and may preferably be greater than the maximum circumferential length of the fixating roller and the pressing roller.

The width w of the solid painted portion should be smaller than the width of a recording material of maximum size supplied and wider than the maximum printable area (the image area). This, is for the purpose of making it possible to clean the widest possible area. Particularly, in the printer of the present embodiment, the right and left ends of the recording material are designed to limit a signal so that the image may not protrude. This is for the purpose of ensuring the quality of image because in the right and left end portions, the image is disturbed by curling or waving. In the case of this test pattern, it is not necessary to ensure the image in the opposite end portions and moreover, the width of the test pattern may preferably be as great as possible in order that it may be used as cleaning paper. Where the cassette 62 can be provided with means for detecting the size of the recording materials, the width w may be automatically set in accordance with the size of the recording materials.

Usually, blanks of the order of 4 mm are provided at the right and left ends. In contrast, the width w may be determined so that the blanks may be 4 mm or less.

Particularly, to clean a greatest possible width, it is preferable to use a transfer material of the greatest usable width as a cleaning sheet.

The user can supply the test pattern output in this manner so that the printed surface thereof may contact with the pressing roller or the like having on the surface thereof an elastic layer having a parting property and a heat resisting property, thereby adsorbing and removing toner and paper powder offset to the surface of the roller. This is because there is good affinity between the solid painted portion and the offset toner and the offset toner can be adsorbed and removed. Particularly, immediately after a test print has been effected, the pressing roller is warm and the cleaning paper is also warm and therefore, the toner is ready to melt, and the cleaning effect becomes greater than when cleaning paper prepared in advance is passed.

When the present invention was carried out and the cleaning of the roller was effected for each 10,000 prints, the service life of the pressing roller could be prolonged up to 150,000 sheets although in the past, the surface of the pressing roller was stained with toner after an order of 50,000 sheets and twining or jamming occurred to give rise to a problem.

Another embodiment of the test pattern image will now be described.

Figure 11A:
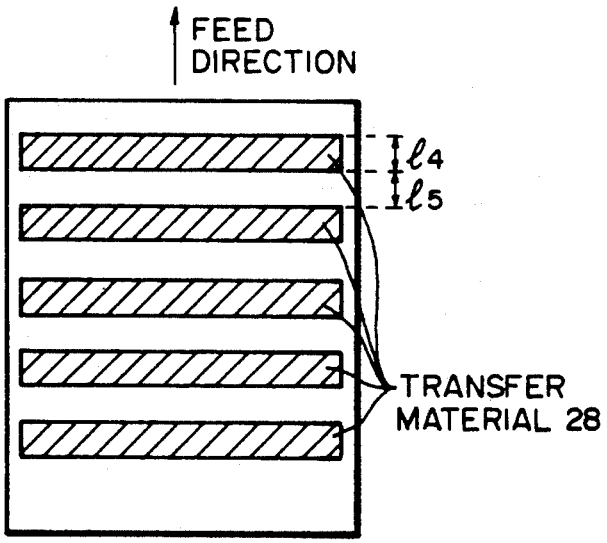
FIG. 11A is a top plan view showing the test print pattern image by another embodiment of the present invention.

FIG. 11A is a top plan view showing a test pattern image.

Figure 11B:
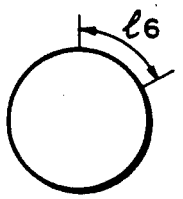
FIG. 11B is an illustration of FIG. 11A.
Figure 13:
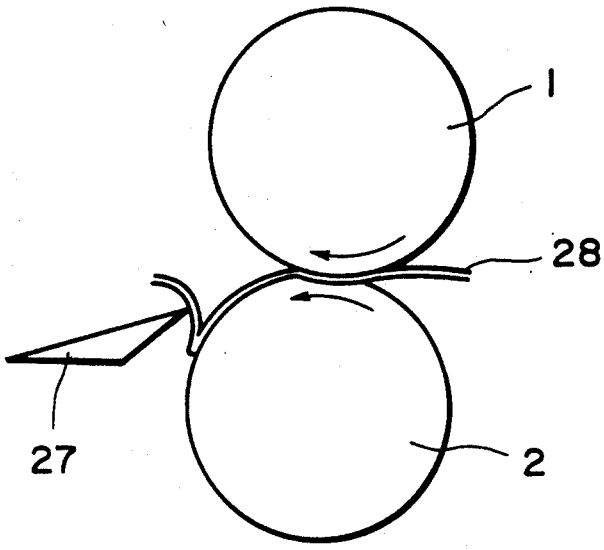
FIG. 13 shows the manner in which a transfer material twines around a pressing roller from halfway.

In the present embodiment, solid painted portions and white ground portions are designed to be alternately printed in the direction of conveyance of the recording material. As shown in FIG. 11B, the length $l_4$ of the solid painted portion is made greater than the length $l_6$ when the outer periphery of a roller to be cleaned is equally divided into $2n-1$, and the length $l_5$ of the blank portion is made so that $l_4+l_5$ equals $2\ l_6$ (n being a positive integer) The number of the solid painted portions is made greater than $2n-1$. By supplying a recording material on which this pattern is printed so that the printed surface thereof may contact with the roller to be cleaned, the surface of the roller can be entirely cleaned. In the first embodiment, if small-dimensioned thin paper is used, because of its weak rigidity, the separability of the recording material of FIG. 13 is improved from halfway of the recording material relative to the pressing roller and thus, it has become possible to prevent twining and at the same time, maintain the cleaning performance.

The reason why in this embodiment, it is preferable that the outer periphery of the roller equally divided into $2n-1$ be $l_6$ is that if the recording material is so divided when twined around the roller, the solid painted portions will not overlap one another during the first and second rounds and cleaning can be accomplished efficiently.

If the solid painted portions and the blank portions are formed at the same period when the outer periphery of the roller is equally divided into 2n, the solid painted portions will overlap one another during the first and second rounds and thus, portions which cannot be cleaned will be formed on the roller. In order to avoid this, there will arise the necessity of providing a blank between the first round and the second round and the procedure of memory or control will be required, and this means an economical disadvantage.

Accordingly, the lengths $l_4$ and $l_5$ of the solid painted portion and the blank portion, respectively, may be arbitrary, but most preferably, design may be made such that as previously described, relative to the length $l_6$ when the outer periphery of the roller is equally divided into $2n-1$, $2\ l_6=l_4+l_5$.

A further preferred embodiment of the test pattern image will now be described with reference to FIG. 12.

This embodiment is such that as in the aforedescribed two embodiments, a solid painted portion is provided and a comment for the user is printed on a blank portion. The substance of this comment may be any if it instructs the user that the paper used is cleaning paper so that the user can rightly perform the cleaning operation by seeing the print on the blank portion which is indicative of the direction in which the cleaning paper should be placed on a paper supply cassette or a paper supply tray (not shown).

Thus, although in the aforedescribed two embodiments, it has sometimes happened that cleaning cannot be accomplished due to an erroneous operation and the pressing roller is stained and cannot keep its life, such a thing does not happen in the present embodiment and also, the apparatus could be made easy for the user to use.

In the above-described embodiment, the cleaning sheet is made in the image forming apparatus and used for this apparatus, and description will now be made of an embodiment using a cleaning sheet for exclusive use.

Figure 14:
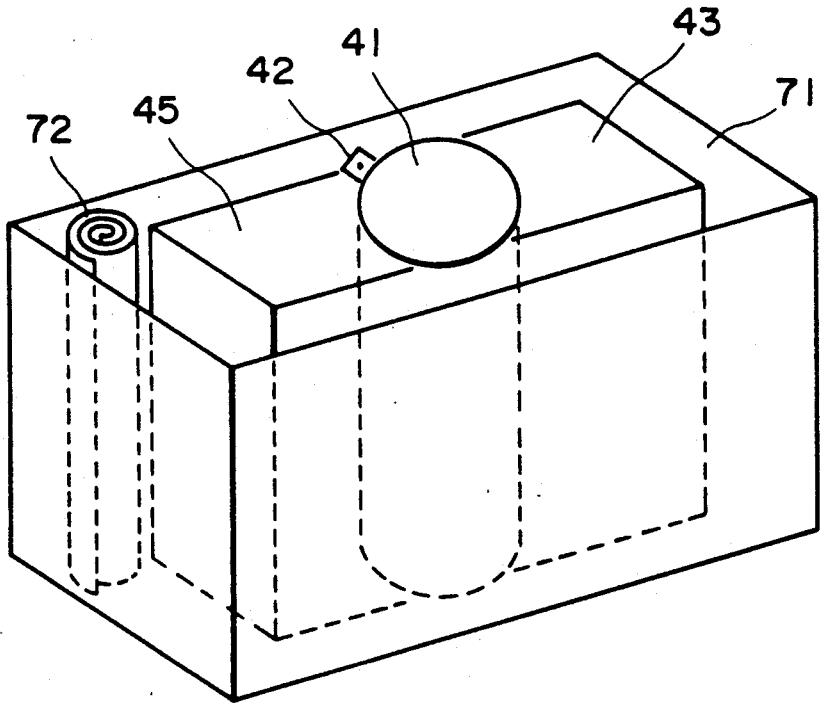
FIG. 14 is a perspective view of an embodiment of the present invention.

FIG. 14 shows the present embodiment, and more particularly shows cleaning paper 72 as it is packed up in the packing container 71 of a process cartridge. As compared with the prior-art method of putting cleaning felt as cleaning means into a cartridge and interchanging the cleaning felt each time the cartridge is interchanged, the method of putting a sheet of cleaning paper into a packing box and passing the cleaning paper once through an image forming apparatus each time the cartridge is interchanged is $$\frac{1}{10}$$

or less in the cost of the cleaning member and also can make the image forming apparatus itself compact.

Figure 10:
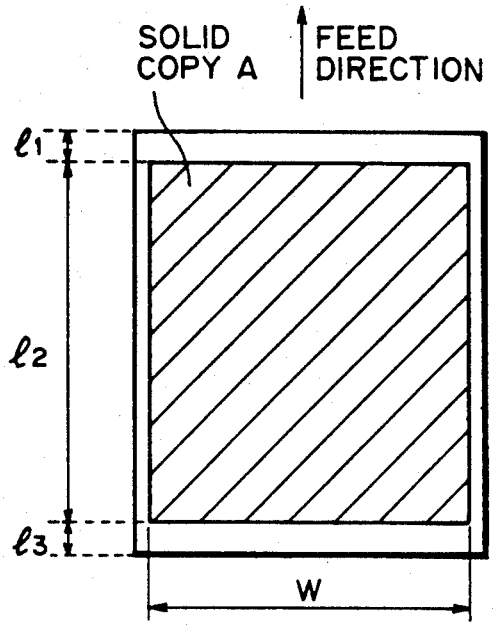
FIG. 10 is a top plan view showing the test print pattern image by an embodiment, of the present invention.
Figure 12:
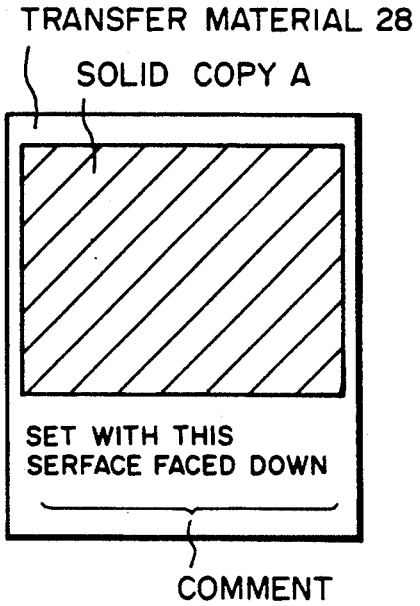
FIG. 12 is a top plan view showing the test print pattern image by still another embodiment of the present invention.

Also, the image pattern as the cleaning paper used may be that of FIG. 10, 11 or 12 already proposed by the applicant.

The paper used as the cleaning paper may preferably have a certain degree of rigidity In the present embodiment, 75 g/m$^2$ paper has been used. Of course, the cleaning paper should be disposed in such a position that it will not be wrinkled even if the cartridge is vibrated.

Figure 15A:
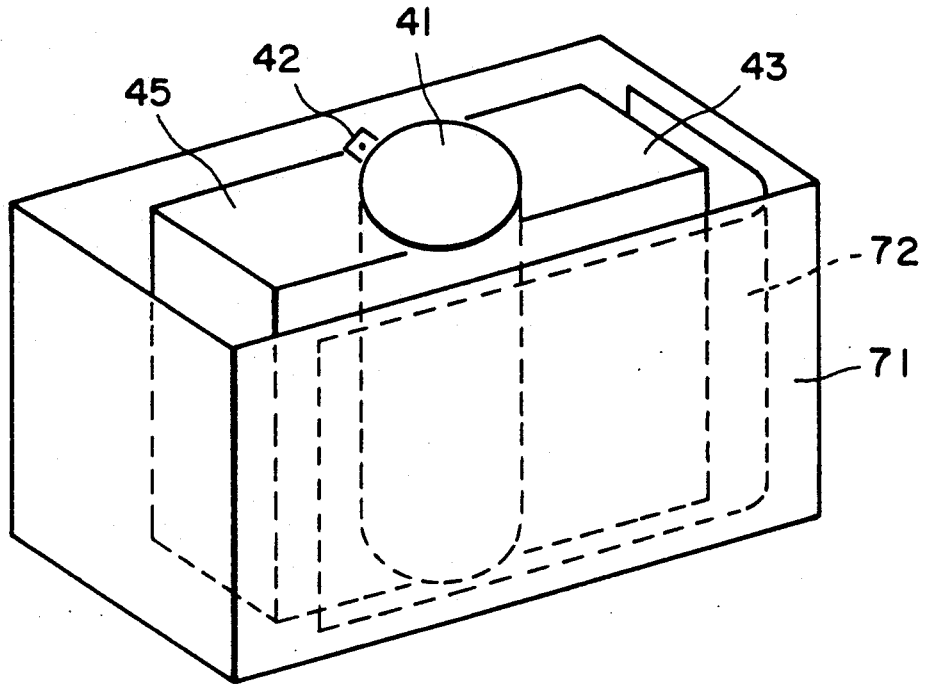
FIGS. 15A, 15B, 15C and 16 are perspective views of further embodiments of the present invention.
Figure 15B:
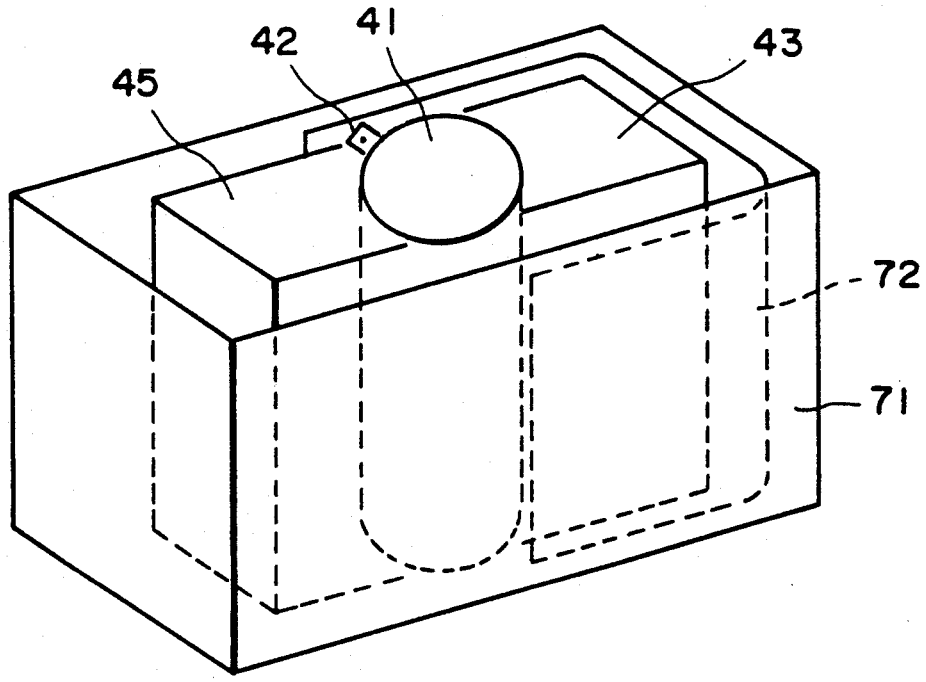
Figure 15C:
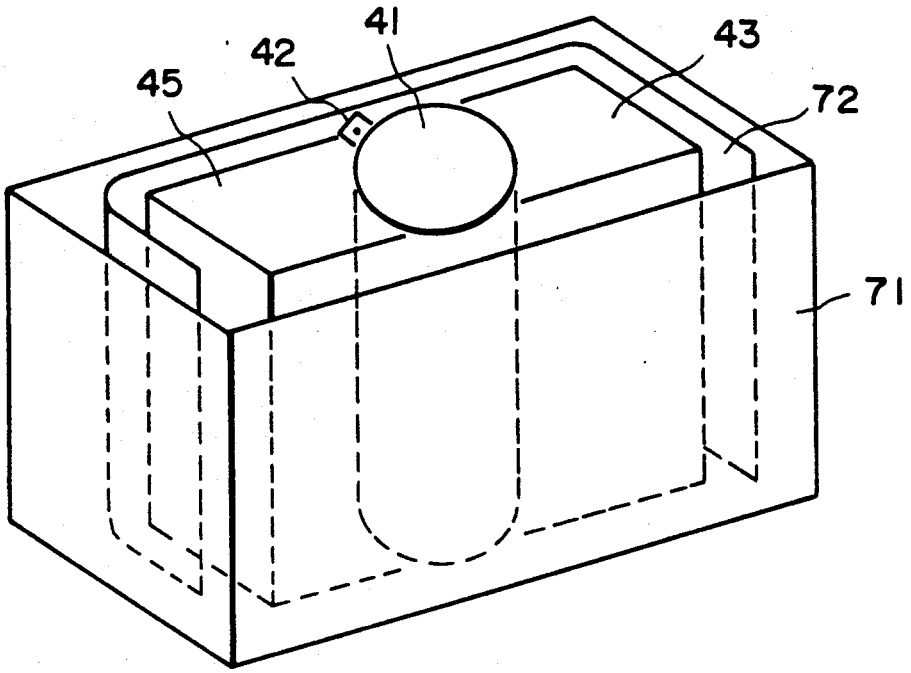

FIGS. 15A, 15B, and 15C are perspective views illustrating another embodiment of the present invention. In the aforedescribed embodiment, the cleaning paper is rolled and placed in the cartridge packing container and therefore, the leading end thereof is curled and the cleaning paper cannot be supplied unless the user stretches the cleaning paper.

In the present embodiment, however, only one or two bends are present halfway of the cleaning paper and the leading end thereof is not curled and therefore, the cleaning paper can be supplied even if the user does not touch the cleaning paper. Thus, it will never happen that during the supply of the cleaning paper, the paper is jammed to trouble the user. The cleaning paper used may be similar to the aforedescribed embodiment.

Figure 16:
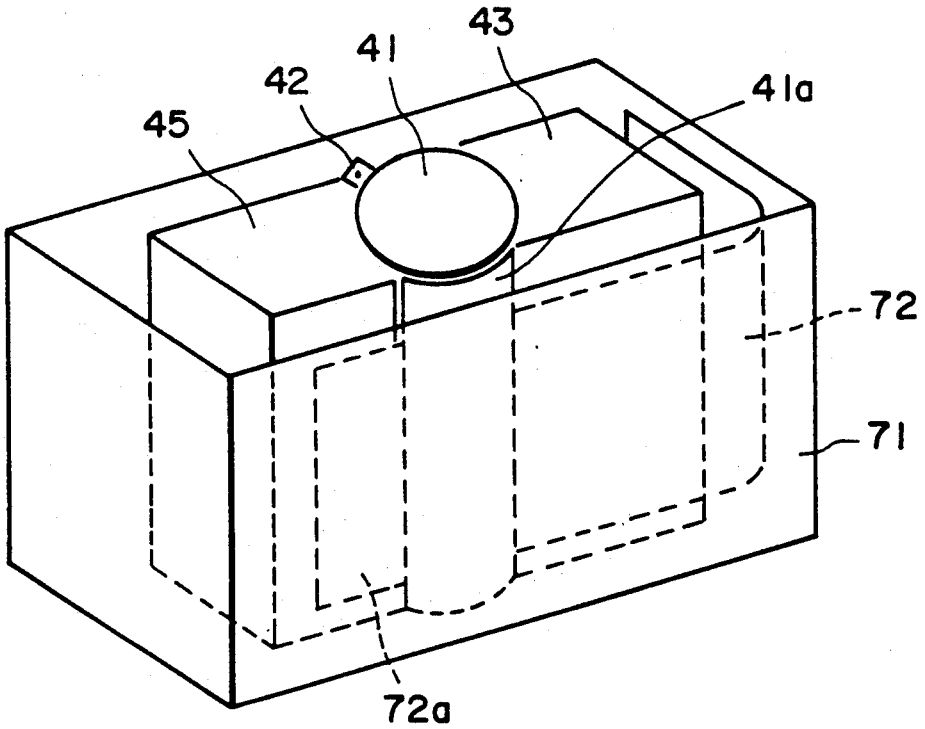

FIG. 16 is a perspective view illustrating still another embodiment of the present invention. Usually, a process cartridge is provided with a drum shutter 41*a* for protecting a photosensitive drum against the occurrence of memory by the outside light or the occurrence of injury by contact. However, it is sometimes the case that when this drum shutter is subjected to a shock in its packed condition, it is flexed and contacts with the photosensitive drum to injure the latter. So, in the present embodiment, as shown in FIG. 16, the cleaning paper is interposed between the photosensitive drum 41 and the drum shutter 41*a* in the packed condition, whereby even if the drum shutter is subjected to a shock in the packed condition, the cleaning paper serves as a shock absorber between the photosensitive drum and the drum shutter and therefore, it will never happen that the photosensitive drum is injured.

The adoption of such a construction, of course, enables the cleaning paper to be used in a manner similar to the aforedescribed embodiment. It would be more preferable to print on the end portion 72*a* of the cleaning paper the instructions for the user to draw out the cleaning paper when the cartridge is to be used, or the instructions as to how to use the clearing paper.

In the aforedescribed embodiments, the process cartridge having an image bearing member and at least one process means for acting on this image bearing member has been mentioned as an example of expendables, whereas this is not restrictive, but if for example, only the developing device is interchangeable, this developing device and the cleaning paper may be packed up, and in short, the present invention can be applied to any expendables which are interchangeable to the image forming apparatus.

Further, the member to be cleaned by the cleaning paper is not limited to the pressing roller of the fixating device as in the above-described embodiments Although some embodiments of the present invention have been described above, the present invention is not restricted to those embodiments, but modifications thereof are possible within the technical concept of the present invention.

We claim:

1. A cleaning sheet for a fixating rotational member, said cleaning sheet having a surface with a middle portion and two end portions as viewed in a conveying direction of said sheet and having:

a tacky layer provided on at least one surface of said cleaning sheet and having tackiness to toner at least when said cleaning sheet is conveyed to said fixating rotational member, said tacky layer being provided over the middle portion and not over the end portions of said surface.

2. A cleaning sheet according to claim 1, wherein said tacky layer because tacky only upon being heated to a predetermined temperature or higher.

3. A cleaning sheet according to claim 2, wherein said tacky layer is formed of thermoplastic resin.

4. A cleaning sheet according to claim 2, wherein said tacky layer is formed of the same toner as toner cleaned.

5. A cleaning sheet according to claim 1, wherein said tacky layer is formed on a sheet substrate which is formed of paper or resin.

6. A cleaning sheet according to claim 1, wherein said tacky layer is provided over the full width of the surface of said cleaning sheet in a direction intersecting the direction of conveyance of said sheet.

7. A cleaning sheet according to claim 1, wherein said cleaning sheet cleans a rotational member opposed to and urged against said fixating rotational member unfixated toner.

8. A method of cleaning a fixating rotational member of an image forming apparatus, said apparatus comprising a photosensitive member, a process cartridge having a developing container for containing unfixated toner therein and being removable from the image forming apparatus, said cleaning method having steps of:

conveying a cleaning sheet having on the surface thereof a tacky layer which is tacky at least when said cleaning sheet is conveyed to said fixating rotational member, the conveyance of the cleaning sheet occurring at intervals concurrent with exhaustion of the toner in said process cartridge.

9. A method according to claim 8, wherein said tacky layer becomes tacky by being heated to a predetermined temperature or higher.

10. A method according to claim 9, wherein said tacky layer is formed of theremoplastic resin.

11. A method according to claim 9, wherein said tacky layer is formed of the same toner as toner cleaned.

12. A method according to claim 10, wherein said tacky layer separates from said fixating rotational member in its melted state.

13. A method according to claim 8, wherein said tacky layer is formed on a sheet substrate which is formed of paper or resin.

14. A method according to claim 8, wherein said tacky layer is provided over the full width of the surface of said cleaning sheet in a direction intersecting the direction of conveyance of said sheet.

15. A method according to claim 8, wherein said tacky layer is provided except for the end portions of said cleaning sheet as viewed in the direction of conveyance thereof.

16. A method according to claim 8, wherein said cleaning sheet cleans a rotational member opposed to and urged against a rotational member which contacts with unfixated toner.

17. A printer apparatus comprising:

image forming means for forming an unfixated toner image on a recording material in conformity with an image signal;

a pair of rotational members for nipping and conveying the recording material therebetween and fixating the unfixated toner image on the recording material;

a ROM for storing an image signal corresponding to a solid image; and a test print switch for inputting the image signal from said ROM to said image forming means to form a cleaning material on which the solid image if formed by operation of said image forming means, wherein said rotation members are cleaned by reconveying the cleaning material therebetween after the cleaning material is discharged outside of the printer.

18. A printing apparatus according to claim 17, wherein the length of the recording material for said solid image in the direction of conveyance thereof is greater than the circumferential length of the rotational member opposite to the rotational member which contacts with the unfixated toner image.

19. A printing apparatus according to claim 17, wherein the width of the recording material from said solid image in a direction orthogonal to the direction of conveyance thereof is greater than the image area.

20. A printing apparatus according to claim 17, further having a test print switch for inputting the image signal from said ROM to said image forming means.

21. A printing apparatus comprising:

image forming means for forming an unfixated toner image on a recording material in conformity with an image signal;

a pair of rotational members for nipping and conveying the recording material therebetween and fixating the unfixated toner image on the recording material; and a ROM for storing an image signal corresponding to a solid image and an image signal corresponding to a comment, wherein both of said solid image and the image of said comment are formed on the same recording material by the output image signal from said ROM.

22. A printer apparatus comprising:

image forming means for forming an unfixated toner image on a recording material in conformity with an image signal;

a pair of rotational members for nipping and conveying the recording material therebetween and fixating the unfixated toner image on the recording material; and a ROM for storing an image signal corresponding to a solid image;

wherein blank portions are provided on leading and trailing end portions of the recording material on which said solid image has been formed by the output signal from said ROM, with respect to the direction of conveyance of said recording material.

23. A disposable article used in an image forming apparatus, having:

a process cartridge comprising a unit in which an image bearing member as the disposable article and at least one process means acting thereon are made integral with said disposable article;

a packing container for packing said process cartridge; and a cleaning sheet for cleaning a fixating rotational member in said image forming apparatus;

wherein said cleaning sheet is contained in said packing container integral with said process cartridge 24. A disposable article according to claim 23, wherein said process means is a developing container for containing the unfixed toner.

25. A disposable article used in an image forming apparatus according to claim 23,. wherein said process means is a cleaner for removing residual toner form the phtotosensitive member.

26. A cleaning sheet for a heat fixation rotational member, comprising a tacky layer provided on at least one surface of said cleaning sheet, the layer having a tackiness to toner at least when said cleaning sheet is conveyed to said heat fixating rotational member, and said tacky layer made of heat fixated toner.

27. A cleaning sheet according to claim 26, wherein said toner is made of thermoplastic resin.

28. A cleaning sheet according to claim 26, wherein said tacky layer is formed on a sheet substrate which is made of paper or resin.

29. A cleaning sheet according to claim 26, wherein said tacky layer is provided over full width in a direction intersecting a conveying direction of the sheet.

30. A cleaning sheet according to claim 26, wherein said tacky layer is provided over the surface of said cleaning sheet except for an end portion of said cleaning sheet as viewed in conveying direction.

31. A cleaning method for cleaning a back up rotational member abutted against a fixation rotational member contacting unfixated toner images, said method comprising the steps of:

forming an unfixated toner image of solid copy on a sheet;

heat fixating the solid copy image on the sheet by said fixation rotational member and said back up rotational member;

discharging the fixated sheet outside of said image forming apparatus;

feeding the fixated sheet with the solid copy image thereof faced to said back up rotational member; and re-heat fixating the sheet whose solid copy image is faced to said back up rotational member by said fixation rotational member and said back up rotational member.

32. A cleaning method according to claim 31, wherein said toner is made of thermoplastic resin.

33. A cleaning method according to claim 31, wherein said sheet is made of paper or resin.

34. A cleaning method according to claim 31, wherein said solid copy image is formed over full width in a direction intersecting a conveying direction of the sheet.

35. A cleaning method according to claim 31, wherein said solid copy image is formed over the surface of the sheet except for both end portions of the sheet in conveying direction.

36. A printer apparatus comprising:

image forming means for forming an unfixated toner image on a recording material in conformity with an image signal;

a pair of rotational members for nipping and conveying the recording material therebetween and fixating the unfixated toner image on the recording material;

a ROM for storing an image signal corresponding to a solid image; and input means for inputting the image signal which is outputted from said ROM to said image forming means to form a cleaning material on which the solid image is formed, wherein said rotational members are cleaned by reconveying the cleaning member therebetween after the cleaning material has passed through said rotational members.

* * * * *

UNITED STATES PATENT AND TRADEMARK OFFICE

CERTIFICATE OF CORRECTION

PATENT NO. : 5,138,390

DATED : August 11, 1992

INVENTOR(S) : MIYABAYASHI, ET AL.

It is certified that error appears in the above-identified patent and that said Letters Patent is hereby corrected as shown below:

IN THE DRAWINGS:

FIGURE 12

"SERFACE" should read --SURFACE--.

COLUMN 6

Line 26, "heartily" should read --heavily--.

COLUMN 9

Line 50, "integer) The" should read --integer). The--.

COLUMN 10

Line 60, "rigidity In" should read --rigidity. In--.

COLUMN 11

Line 67, "because" should read --becomes--.

COLUMN 12

Line 14, "unfix-" should be deleted.
Line 15, "ated toner" should be deleted.
Line 65, "if" should read --is--.

UNITED STATES PATENT AND TRADEMARK OFFICE

CERTIFICATE OF CORRECTION

PATENT NO. : 5,138,390

DATED : August 11, 1992

INVENTOR(S) : MIYABAYASHI, ET AL.

It is certified that error appears in the above-identified patent and that said Letters Patent is hereby corrected as shown below:

COLUMN 13

Line 56, "cartridge" should read --cartridge.--.

Line 62, "form" should read --from--.

Signed and Sealed this

Nineteenth Day of October, 1993

Bruce Lehman

BRUCE LEHMAN

*Commissioner of Patents and Trademarks*

*Attest:*

*Attesting Officer*